United States Patent [19]

Pendergast

[11] Patent Number: 4,633,877

[45] Date of Patent: Jan. 6, 1987

[54] DYNAMIC FOOT SUPPORT AND KIT THEREFOR

[75] Inventor: Hugh L. Pendergast, Lafayette, Ind.

[73] Assignee: Duramet Systems, Inc., Fort Wayne, Ind.

[21] Appl. No.: 638,878

[22] Filed: Aug. 7, 1984

[51] Int. Cl.[4] ..... A43B 13/38; A61F 5/14

[52] U.S. Cl. ..... 128/581; 36/44

[58] Field of Search ..... 128/581, 81 R, 615, 128/619, 621, 622, 623, 614, 607, 595, 586; 36/43, 44, 25 R, 28, 30 R, 30 A, 36 R

[56] References Cited

U.S. PATENT DOCUMENTS

| | | | |
|---|---|---|---|
| 2,662,309 | 12/1953 | Morton | 128/581 X |
| 2,863,231 | 12/1958 | Jones | 128/615 |
| 3,170,250 | 2/1965 | Scholl | 36/44 |
| 3,449,844 | 6/1969 | Spence | 36/44 |
| 3,892,077 | 7/1975 | Wolstenholme et al. | 36/44 |
| 3,922,801 | 12/1975 | Zente | 36/44 |
| 4,130,948 | 12/1978 | Krug | 36/44 |
| 4,364,189 | 12/1982 | Bates | 36/30 R X |
| 4,408,402 | 10/1983 | Looney | 36/43 |

FOREIGN PATENT DOCUMENTS

| | | | |
|---|---|---|---|
| 2371897 | 7/1978 | France | 36/43 |
| 2528674 | 12/1983 | France | 36/43 |
| 28430 | of 1906 | United Kingdom | 36/25 R |

*Primary Examiner*—Clifford D. Crowder

*Attorney, Agent, or Firm*—Pearne, Gordon, Sessions, McCoy, Granger, & Tilberry

[57] ABSTRACT

An orthotic device which includes a resilient member having a perimetral outline conforming to a predetermined portion of the human foot. This resilient member includes a plurality of segments, each of these segments having a perimetral outline conforming to a predetermined different portion of the human foot. All of the segments are of the same uniform thickness. The durometer of the segments are selected from one of a group of ranges of durometer 120 BHN or less, 140 BHN, and 180 BHN and greater.

22 Claims, 10 Drawing Figures

FIG.6a
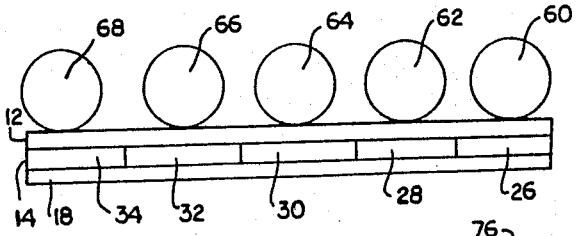
FIG.6b
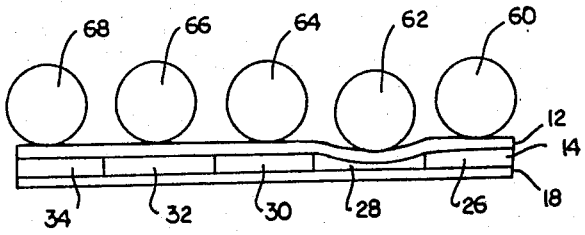
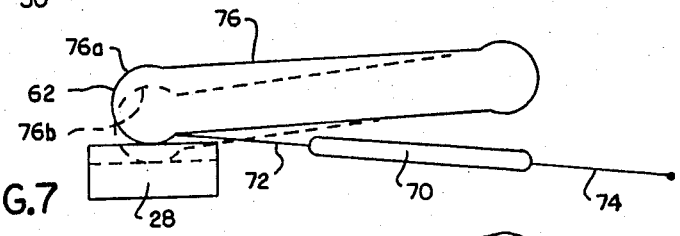
FIG.7
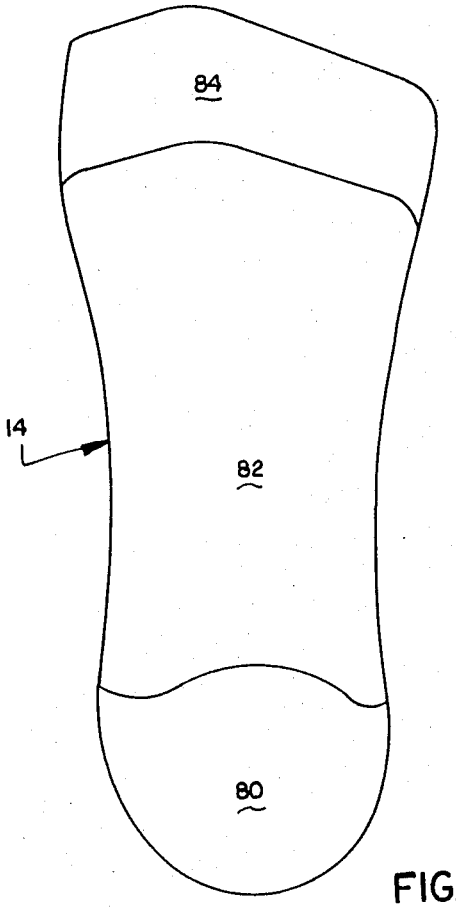
FIG.9
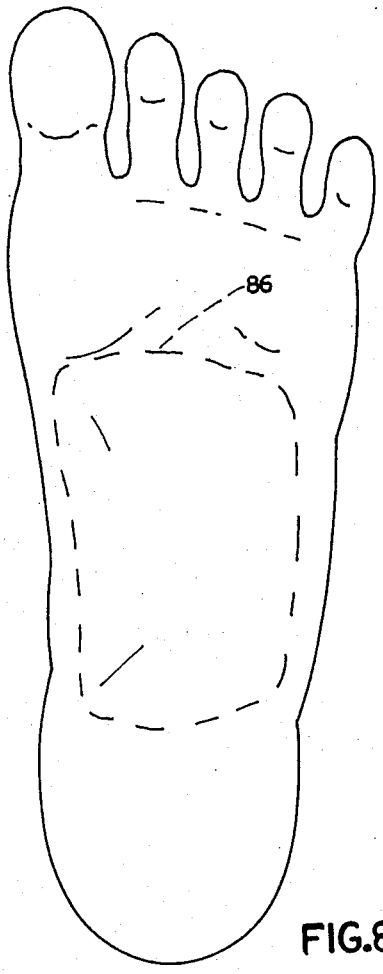
FIG.8

DYNAMIC FOOT SUPPORT AND KIT THEREFOR

FIELD OF THE INVENTION

The present invention relates to orthotic devices and, more specifically, to a device having from one to a plurality of elements, each element conforming to a different selected functional portion of the plantar surface of a foot. Each element is made of a material of the same uniform thickness and has a selected predetermined durometer or firmness, the elements being interposed between the insole of a shoe and the plantar surface. The durometer or firmness of the individual elements is selected to, independently, effect a desired percent of descent and control of dwell time of the muscular-skeletal foot structure corresponding to the aforesaid plantar surface portion to produce a specific orthotic response, the resultant action being produced by the combined action of the elements, dynamic movement and pressures imposed by the foot, the weight of the user, and the natural ability of the muscle, tendon, nerve, and related anatomy of the foot to function and self correct as the device is worn.

DESCRIPTION OF THE PRIOR ART

External orthotic treatment of the human foot is desirable and often necessary treatment for malformation, weakness, injuries, and even simple comfort of the foot. Such devices are often required even for a normal foot subjected to the additional stresses of exercise and/or athletics.

Heretofore, many orthotic devices for such purposes have been custom fabricated, the fabrication being performed by a podiatrist or other medically trained person. One class of such devices are referred to as rigid orthotics. They are most commonly made of acrylic plastic formed over a cast. This is called "intrinsic posting". The positive cast is modified and the plastic orthotic is formed using the altered cast. The particular shape of the supporting member is developed by taking cast of the individual's foot, the mold itself being produced from filling the cast with plaster to form a positive cast. The cast thus formed, while it can be made with the individual standing or otherwise placing pressure on the foot, is formed under conditions in which the foot is, for all intents and purposes, static, that is, not moving or otherwise in use.

Another class of orthotic devices are those using cushions interposed between the plantar surface and a rigid supporting member such as the insole of a shoe or the specially contoured "rigid orthotic" devices as discussed above. These devices attempt to diffuse or distribute excess pressure applied to the plantar surface.

Underlying the limitations of such prior art orthotic devices, and as a basic premise of the present invention, is a recognition of the structure and function of the human foot and its function in the body's neuro-muscular system. A preliminary discussion thereof is appropriate.

In a series of articles published in the periodical, "Physical Therapy," Volume 59, No. 1, in January of 1979, the results of treatment of patents suffering from desensitized limbs are reported. Such desensitizing of the limbs often occurs in suffering from Hansen's Disease or from other pathological causes such as strokes and traumatic injury. In these studies, it was found that patients suffering from this type of pathology frequently experienced injury and serious degeneration of bone, muscle, and soft tissue of the foot simply because, in the absence of any sensation of pain or discomfort, otherwise minor irritations and discomforts go unnoticed, thereby allowing the irritations to compound and ultimately cause significant and even permanent injuries.

Recognition of this phenaomena leads to a recognition that the human foot comprises several sophisticated and interrelated systems, all of which participate both at subconscious and conscious levels to manipulate and protect the foot and related muscular-skeletal structures as the foot performs one or more of the functions of the ambulatory sequence of balance, support, and propulsion. In contrast to a rigid supporting device, such as the base of a lamp, the human foot is dynamic and responsive to its environment and activity. It not only supports the weight of the body in a static state, but also performs both subtle and obvious changes in contour and movement as it performs its functions. The plantar surface of the foot alone, while relatively thin, actually comprises twenty-six separate layers, including two layers of skin tissue, ten layers of connective tissue, three layers of veins, four separate sets of nerves, four layers of muscles, and a skeletal system comprising a multiplicity of bones.

In function, the various exterior and internal nerve systems monitor physical parameters of force, pressure, extension, and the like of muscles, joints, tendons, etc. The signals from the nervous system function with the brain and closed loop reflex nerve systems to produce appropriate reactions in the muscle and tissue layers. It is through this sensory feedback and control system that the foot provides the basic functions of the ambulatory sequence as well as providing appropriate warnings to hostile stimuli, such as, for example, stepping on a foreign object, irritation, over-extension, stress fatigue, etc. A more detailed discussion of the functioning of the body is to be found in the book "Kinesiology and Applied Anatomy" by Rasch and Burke, sixth edition, published by Lea & Febiger 1978; in chapter 5.

For example, a normal foot, upon sensing the presence of a foreign object, responds to the stimulus by alerting the person to remove the irritation or, at least, to alter the gait to minimize the irritation. In a similar manner, when feet become tired, the normal sensations of irritation and fatigue are implemented through the sensory feedback system to produce an alteration of the gait to redistribute pressure away from irritated areas, reduce impact, and the like. The nerves in response to excess stress or extension of a muscle, tendon, etc. produce inhibition of muscle action and facilitate the activity of antagonist muscles.

Accordingly, because of the multiple and dynamic functions performed by the foot and foot related structure, prior art orthotic devices have been less than fully effective. With posted devices, for example, the supporting elements or posts, such as the arch support, or rigid, contoured insoles, may be detected by the plantar surface as a foreign object that can cause a response more detrimental than the initial malady. Such devices are directed at supporting the skeleton of the foot. Such devices often ignore the many layers (muscle, nerve, etc.) of the plantar surface and simply treat the foot as if it were purely a skeletal, static, and rigid object. These devices make little or no allowance for movement of the various anatomical portions of the foot. Such devices can, and often do, simply transfer a point of irritation from one part of the anatomy to another and may in fact detrimentally immobilize portions of the foot.

Cushion devices can result in confusing messages to the foot. Such devices are frequently of excessive thickness such that portions of the plantar surface sense them as a foreign object as the devices are contacted and compressed by the foot. Such devices attempt to diffuse pressure or absorb impact. However, because the resilience of this type of device is substantially uniform, the transfer or diffusion of pressure is not controlled. The resilience and relative softness of such devices can further provide an unstable surface for the foot, thereby interfering with the balance function, and can, by affecting the dwell time of various portions of the foot, reduce effectiveness of the foot in its propulsion stage, thereby resulting in undesired extension and contraction of muscles and alteration of the gait. Such a reaction is, for example, discussed in an article in the publication, "Scientific American," Volume 239, No. 6, December 1978, and entitled "Fast Running Tracks".

It should further be noted that prior art orthotic devices tend to be expensive, the devices often being custom-fabricated by specially trained personnel. Such devices are often relatively thick in vertical cross-section and require the use of specially constructed and expensive footwear.

While corrective treatment of the foot is desirable and often necessary, it is nonetheless preferable to allow the muscles, tendons, and related anatomical elements of the foot to compensate to at least some degree for the deformities of and stresses placed on the foot. Prior art foot supports, because of their rigid nature and by reason of the fabrication of such supports under substantially static conditions, do not allow the foot to yield any self-corrective response. This often produces atrophy of already weak muscles.

SUMMARY OF THE INVENTION

Broadly, the present invention is an orthotic device comprised of one or more segments fabricated from a material selected from one of a plurality of materials. All of the segments are of the same thickness such that, when assembled, the device will be "flat" from side to side, and functionally flat from posterior to anterior. That is, the foot sees or senses a flat surface as it goes through the ambulatory sequence, but selected from materials having a predetermined range of firmness, the different values providing segments which can be described as firm, neutral, and soft based upon their effect on the corresponding functional portion of the foot. The individual segments are shaped and proportioned to underlie the specific functionally distinct portions of the plantar surface, these being the heel, the lateral and medial mid-foot and the metatarsal heads. When joined, the segments form a device which conforms to the plantar surface. Each segment is compressible independently of adjoining segments to produce a controlled descent of the corresponding portion of the foot and, correspondingly, a desired kinesthetic orthotic response in the corresponding functional portion of the foot (including the plantar surface, related muscles, skeleton, tendons, connective tissue etc.) independently of the effect of adjoining segments and their effect on other portions of the foot.

Preferably, a fixible "mask" layer overlies the segments to mask the junctures thereof to provide a receptive contact surface without significantly affecting the independence of the function of the elements or segments. A base layer, made of the same type of material as the surface may underly the assembled segments. The firmness of the base layer can also be selected from a range of durometers or firmness and produces a multiplication factor for the action of all of the segments.

The device is of uniform thickness. The vertical dimension of the device is relatively thin allowing the device to be used in ordinary foot wear without modification. While all of the segments of a particular device are of the same thickness, a plurality of different thicknesses can be utilized for all of the segments of a particular device to effect further range or variation.

In a specific embodiment of the invention, various segments of the device and the mask and base layers are provided in a selectively assembleable kit conforming to a standard shoe size. It is therefore, an object of the invention to provide an improved orthotic device.

Still another object of the invention is to provide such a device which comprises a plurality of segments each conforming to a predetermined functional portion of the plantar surface of a foot and of selectively different firmness for effecting different kinesthetic effects on the corresponding functional portion of the foot.

Yet another object of the invention is to provide such a device which effects controlled descent of the corresponding functional portions of the foot.

Another object of the invention is to provide such a device which is in part shaped or formed in the shoe as it is used.

Still another object of the invention is to provide such a support of minimal vertical dimension.

Another object of the invention is to provide such a device which is fabricated in a plurality of segments, each segment conforming to a different predetermined functional portion of the foot and each set of segments conforming to predetermined standard shoe sizes.

BRIEF DESCRIPTION OF THE DRAWINGS

The objects, features and advantages of the invention will be apparent from the following description of a specific embodiment of the invention, as illustrated in the accompanying drawings, wherein:

FIGS. 6*a*, 6*b*, and 7 are diagrammatic illustrations useful in explaining the configuring and function of a device in accordance with the present invention;

FIG. 8 is an illustration of the plantar surface of the human foot with specific functional areas thereof outlined in dashed lines; and FIG. 9 is a plan view of the control layer of a neutral orthotic in accordance with the invention.

DESCRIPTION OF A SPECIFIC EMBODIMENT

Figure 3:
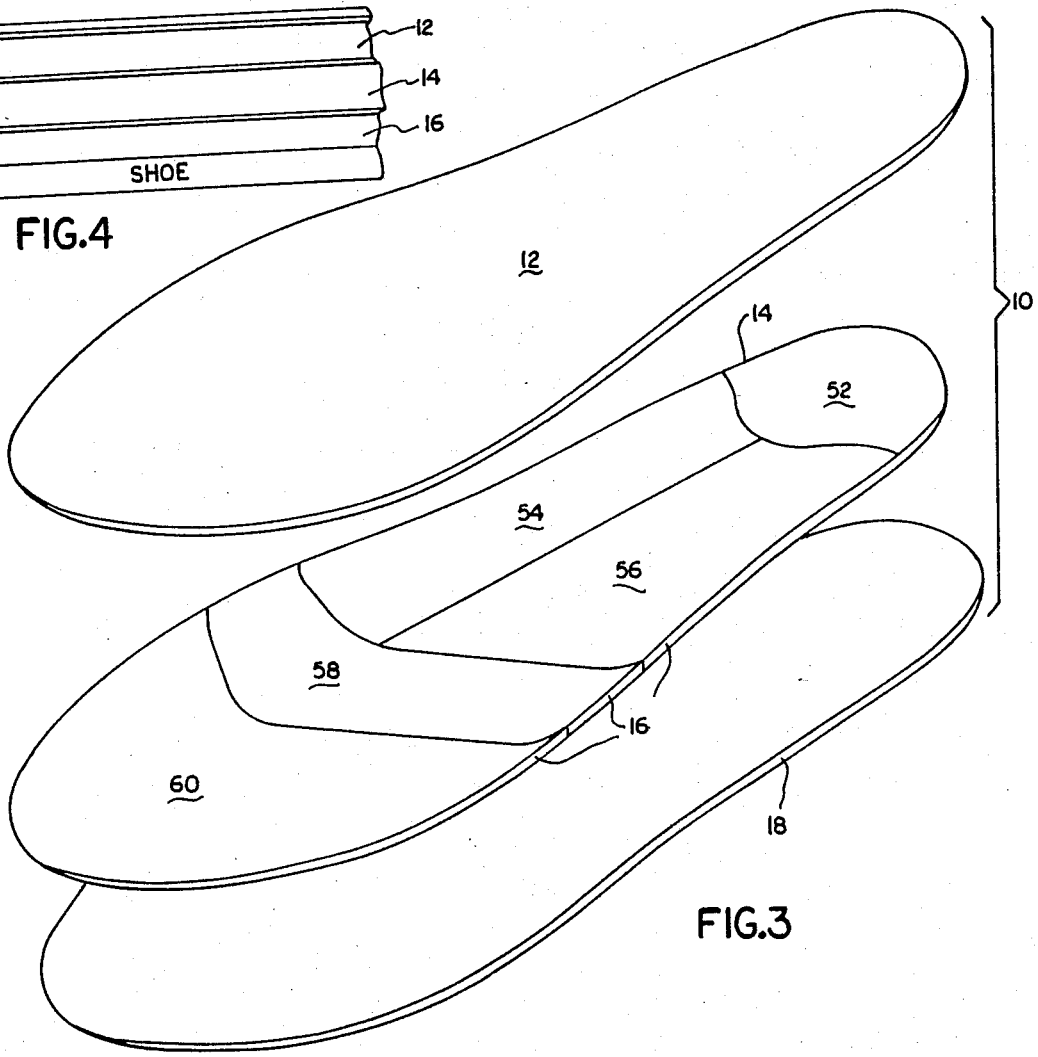
FIG. 3 is an exploded perspective view of yet another embodiment of a device in accordance with the invention.

Referring now to the drawings there is shown in FIG. 3 one embodiment of a orthotic device, indicated generally at 10, in accordance with the present invention. The support comprises generally three layers; a mask layer 12 made of a flexible, smooth, and slightly resilient material; a controlled density, orthotically functional, "control" layer 14 comprised of a plurality of segments 16 to be described in more detail below; and a "base" layer 18.

The mask layer 12 provides as its primary functions a comfortable engagement with the corresponding soft tissue and sensory nervous system of the plantar surface of the foot and provides absorbtion of perspiration. The layer 12 also provides for a smooth resilient mask between the foot plantar tissues and the functional portions of the device 10 in layer 14 (explained below) and also provides mechanical location of the segments 16 of the control layer 14.

Figure 1:
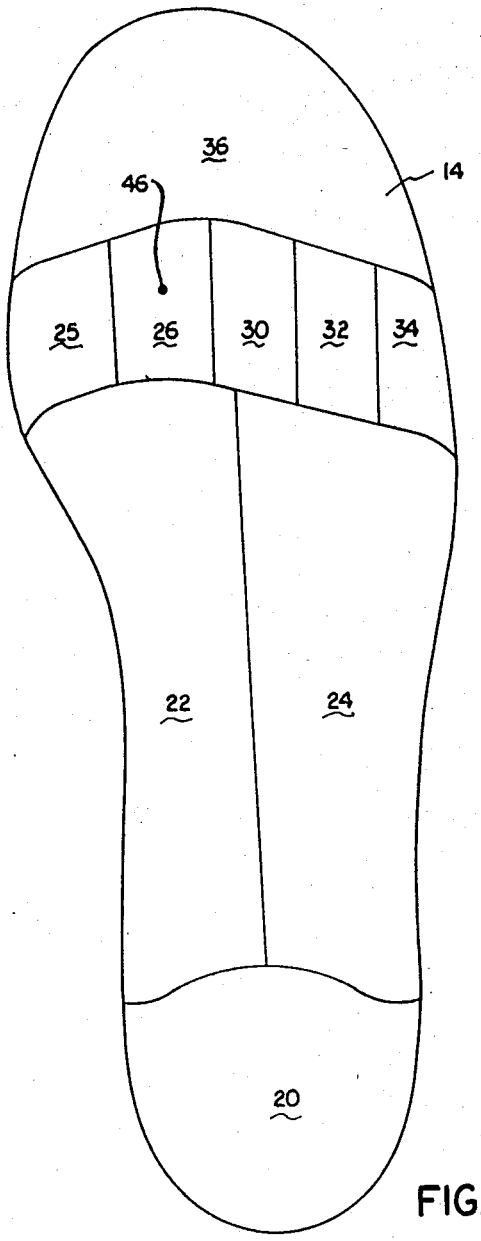
FIG. 1 is top plan view of the orthotic device of the present invention.
Figure 2:
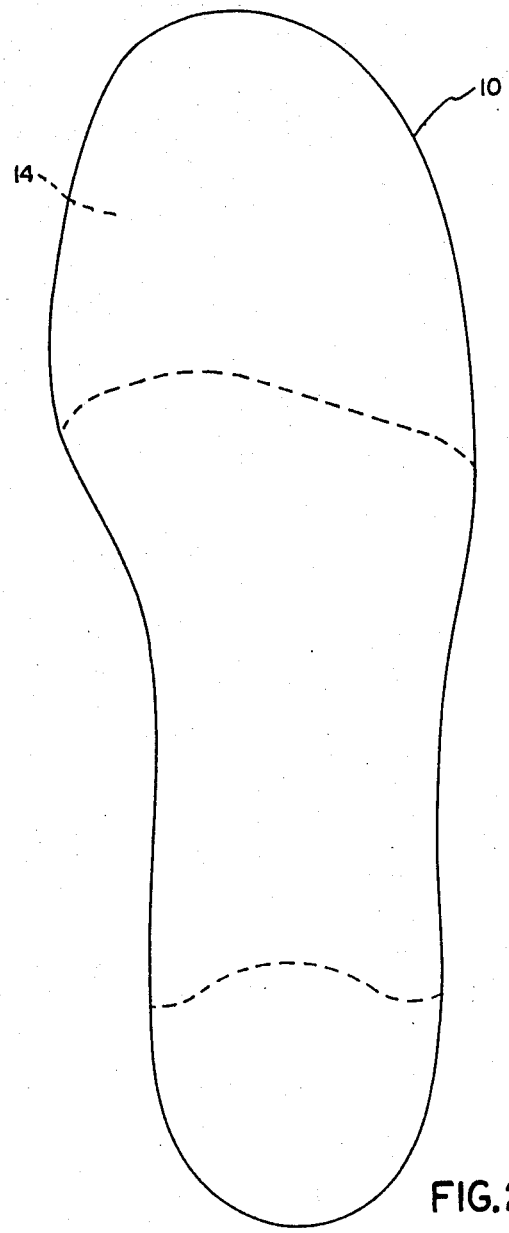
FIG. 2 is a top plan view of an alternative embodiment of the present invention.

The control layer 14, as seen in FIG. 1, is comprised of segments 20,22,24,26,28,30,32,34, and 36. The various segments are complementary in their peripheral configurations, whereby the individual segments 20–36 can be joined together to form the complete control layer 14.

Figure 5:
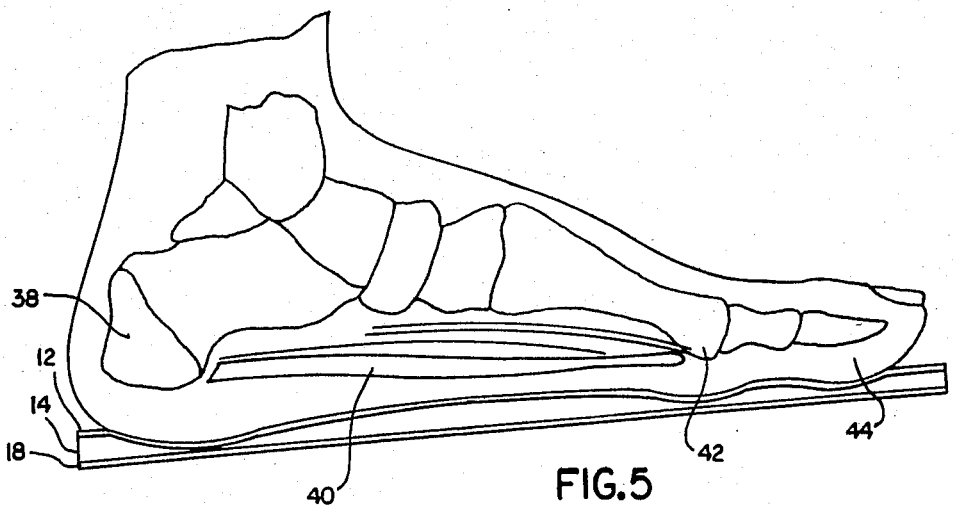
FIG. 5 is a side plan view of the device of the invention shown in conjunction with a diagrammatic illustration of the human foot.
Figure 4:
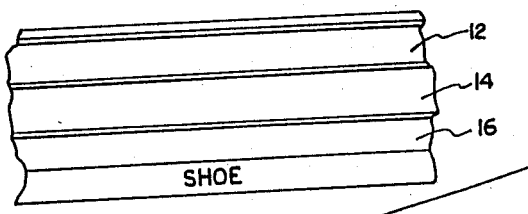
FIG. 4 is a fragmentary cross-sectional view of a device in accordance with the invention showing the layers thereof.

Segment 20 is shaped and proportioned to underlie the heel of calcaneous 38 (FIG. 5). Similarly, segments 22 and 24 underlie the medial and lateral arch portion 40 of the foot, segments 26,28,30,32, and 34 underlie individual ones of the metatarsal heads 42 and segment 36 underlies the toes 44.

It will be observed that the metatarsal segments 26 through 34 are set at an angle of 142.5° from a point 46 designed to fit under the second metatarsal head, this having been determined as the median average of the American foot according to an American Podiatry Association survey. This angle may of course be varied for specific cases. The segments are all dimensioned to avoid contact with adjacent portions of the foot. That is, each segment 20–36 underlies a single functional portion of the foot. Further, it will be seen that the entire device, when assembled as shown in FIG. 1, is planar. That is, it is of uniform thickness and each of the various layers is also planar, i.e., having constant vertical cross-section or thickness. This is in contrast with conventional, currently used, posting devices, which are typically molded to have a variable vertical surface and/or cross-section or are fitted with various pads, bumps and vertically dimensioned correctional inserts.

It will be seen that the various segments 20–36, in fact, comport to each of the basic anatomically functional areas of the foot. That is, the various segments underlie the basic areas of the foot such as the calcaneous, mid foot, and metatarsal heads which are anatomically controlled individually or in combination by the musculoskeletal systems of the body relative to other portions of the foot both in use and to effect correction.

It is important to recognize that each of the functional portions of the foot, (calcanious, medial and lateral mid foot, and metatarsal heads) function substantially independently as the foot performs its functions and that each of these individual functional portions is a whole that cannot be functionally subdivided. Any effort to subdivide a functional portion will result in skeletal misalignment.

To effect the desired functional orthotic control unique to the present invention, the various segments are each fabricated from materials of selected durometer or firmness within a predetermined range of durometers and each segment, being a separate element, acts independently in concert with the functional portion of the foot with which it is associated.

Based on the weight of the user for example, it has been found that when a particular segment is fabricated from a material of durometer 120 or less (Brinell hardness number, "BHN", 120 kg/mm$^2$ or less), the material will be substantially fully compressed when subjected to pressure from the corresponding portion of the foot providing dispersion of pressure and maximum descent of the corresponding portion of the foot. Segments fabricated from a material of a durometer of about 142 (Brinell hardness number 142 kg/mm$^2$) are effective for medium descent of the corresponding portion of the foot under normal body weight placed upon that portion of the foot. Materials of a durometer of 180 or greater (Brinell hardness number 180 kg/mm$^2$ or greater) will yield the least. Accordingly, by selecting the durometer or firmness of the individual segments from materials having durometer value in the range of 180 or greater, the various segments can be configured to produce a varied range of compression and, correspondingly, depression or descent for the corresponding portion or the foot.

By further varying the thickness of the device but, maintaining the thickness of all of the segments the same, for example in a range of about 16 mm to 160 mm, vertical compression or descent of a corresponding portion of the foot can be further varied over any desired range.

A preferred material for fabrication of the segments 20–36 is polyvinylchloride foam.

A closed cell microcellular polyethylene material has also been found to be highly effective for the variable durometer material of the invention. The materials further have the characteristic of assuming a partial set after a period of use.

It is the controlled descent of the corresponding foot portion that is a primary factor in the effectiveness of the orthotic device of this invention. Specifically, the firmness of the material will control the magnitude of descent of the corresponding foot portion into the orthotic device. That in turn provides a means to control the magnitude of extention (tonic response) and contraction of the muscles, tendons, etc. connected with the corresponding foot portion. The firmness of the segment also provides a means for controlling the "dwell time" (the time required for a functional portion of the foot to perform its function in the ambulatory sequence) of the foot portion as it functions in the ambulatory sequence of support, balance and propulsion as will now be apparent in view of the aforementioned article in Scientific American. A soft material will, for example, allow maximum contraction of muscle, and will reduce extention of the muscle, while a firm material will produce the opposite effects. A soft material will increase the dwell time, i.e., the time required. A firm material will decrease dwell time and increase the speed at which a functional foot portion performs its function. This effect is identified as the phasic response of the related anatomical structure.

A more detailed analysis of the effects of static length of a muscle and the speed and duration of contraction of a muscle (tonic and phasic response, respectively) are presented in the book "Understanding the Scientific Bases of Human Movement" 2nd Edition, by Gowitzke and Milner (1980) and in particular in chapter II. The combined effect achieved by varying the firmness of a segment is, therefore, control of extention, tension, and dwell time.

It will also be recognized that the relative durometers of adjoining segments will directly affect the relative movement (descent and dwell) of adjoining functional portions of the foot. Accordingly, a "soft" segment adjoining a "medium" segment will have a different effect than using a soft segment adjoining a "firm" segment. Conversely, a "soft" segment adjoining a "medium" segment and a "medium" segment adjoining a "firm" segment may produce the same effect on the relative action of the adjoining functional portions of the foot but different absolute effects.

These effects and their relationship to the anatomy of the foot can be better visualized with reference to FIGS. 6*a*, 6*b*, and 7. The five metatarsal heads are indicated by circles 60,62,64,66, and 68 (with attendant tissue layers which are not shown for clarity) which overlie the mask layer 12, segments 26,28,30,32, and 34, respectively, and base layer 18. FIG. 6*a* represents the metatarsal heads in a non-stressed condition. The mask layer 12 is level, segments 26–34 are not compressed, and the base layer 18 is not compressed and is substantially planar, or, at least, conforms to that structure upon which it rests.

Assuming a "soft" segment 28, and firm segments 26,30,32, and 34, at the point of maximum pressure, (typically the final stages of balance and propulsion in the ambulatory sequence for the metatarsal heads) the metatarsal heads 60–68 assume the relative positions shown in FIG. 6*b*. Because segment 28 is "soft", it will compress more than firm segments 26,30,32, and 34 allowing a maximum descent of metatarsal head 62. Because segment 28 is separate, (not connected to adjoining segment 26 and 30) this increased descent of metatarsal head 62 is substantially independent of the movement of metatarsal heads 60,64,66, and 68.

It will also be observed, however, that because the base layer 18 also compresses, some additional descent of all of the metatarsal heads will occur. However, if the absolute pressure exerted by the individual heads 60–68 is substantially equal at the point of maximum pressure, (FIG. 6*b*) the descent will be substantially the same for all of heads 60–68, and while the total movement of all of the metatarsal heads 60–68, will be increased by compression of the base 18, the relative movement between individual ones of the metatarsal heads will be substantially unaffected by the base layer 18 compression.

Referring now to FIG. 7, this activity can now be related to the function of the muscle 70 and associated tendons 72 and 74. It will be seen that in the stressed rate, the metatarsal bone 76 is in a position indicated by solid lines 76*a*. At the point of maximum descent the bone 76 is in a position indicated by dashed line 76*b*. Correspondingly, the amount of contraction allowed and occurring in muscle 70 when metatarsal head 62 produces a maximum amount of support and/or pressure, is also a maximum. If bone 76 acted alone, the time required for the bone etc. in FIG. 7 to cycle from minimum descent, minimum contraction, to maximum descent, maximum contraction and back would be increased. That is, the dwell time would increase. However, since four adjoining metatarsal heads are also acting in synchronism with head 62, only the magnitude of contraction of the muscle 70 is affected.

The net result of this action is a net reduction in the stress on the anatomy associated with segment 28 and a simultaneous increase in the work performed by adjoining portions of the foot.

To further extend this analysis, if it is not desired to increase the total effect on adjoining metatarsal heads, the segments 60, 64, 66, and 68 may be made of a "neutral" firmness material and the mid foot segments 22, 24, and toe segments 36 may be made of a "firm" material to effect less relative extension of the metatarsal anatomy. The segments 60, 64, 66, and 68 may be of "firm" material and the arch and toe segments 22, 24, 36 of neutral material if it is desired to reduce the dwell time on all of the metatarsal heads.

Referring now to FIG. 9, there is shown in plan view, the control layer 14 of a orthotic for use with a "normal" foot. This layer 14 includes a heel segment 80 of soft material and mid foot segment 82 of medium firmness material and metatarsal segment 84 of soft material. Of primary significance in this embodiment is the use of the medium material for mid foot segment 82. This segment contacts the mid foot which, as illustrated in FIG. 8, contains the major portion of the sensory nerves of the plantar surface, this sensory area being outlined with dashed line 86. Careful experimentation has shown that a normal foot produces a most favorable response when it encounters this configuration. It is believed that this configuration in fact most closely simulates the sensory response that a normal foot would produce if walking on flat, soft earth. That is, the segments provide impact absorption, dispersion of pressure, and contact responses simular to those that are most acceptably perceived by a normal foot in a desireable environment.

It should also be noted that in this embodiment, no toe segments are used. It has been found that the toe segments are the least functional and it is often helpful to eliminate the toe segments completely to provide additional space in the top area of shoes, which in turn further facilitates use of the present invention in conventional footwear.

A discussion of the entire spectrum of possible variations of soft, nuetral, and firm segment configurations, and their use in treatment of specific maladies is of course beyond the scope of this disclosure.

It should be observed that the individual segment 20–36 are not attached or otherwise secured to adjoining ones of the segments. This enables each segment to act independently. It will also be seen that the actual number of segments required and used, as well as their shape, can be varied. In a configuration as shown in FIG. 1, a separate segment is provided for each functional part of the foot and maximum versatility is provided. However in many applications, such as irritation of the heel, the need for separate metatarsal segment 26–34 and separate medial and lateral mid-foot segments 22,24, does not exist and these segments may be provided as a single integral unit of desired firmness.

It will also be observed that while specific values of firmness have been described, it will now be apparent to those skilled in the art that the classification of these materials as soft, medium, and hard is anarbitrary definition useful in this disclosure for convenience in describing the function of the segments. Materials having "Shore" values of from 5A to 50A have been found effective. Selection of a particular hardness or "firmness" is ultimately to be based upon the stretch, contraction, and dwell desired. While the polyvinylchloride foams and polyethylene foams above described have been found effective, other materials can also be used. Useable materials will exhibit the characteristic of impact absorption and compression (incontrast with resilience).

Layers 12 and 18 also co-operate with the segments of control layer 14 to contribute to overall effectiveness of the orthotic 10 of the present invention.

Base layer 18, in a working embodiment, is made of the same type of material as segments 20–36, typically of a firm material. The base 18, in addition to providing material to which segments 20–36 can be bonded, also acts as a multiplier for the individual segments. That is, base 18 will increase the effective thickness of the segment and will correspondingly alter the dwell time, muscle extention etc. This factor can be controlled or selected as with the segments to produce a desired result.

Mask layer 12 may also be bonded to the segments but in overlying relationship. The primary functions of the mask layers 12 are: to provide a smooth, anatomically acceptable surface for the plantar neuro surface; (absorbtion of perspiration:) utilizing a resilient material, provision of a limited amount of cushioning. A cover layer, not shown, may be used to provide an aesthetically pleasing surface which may be important when orthotic devices in accordance with the invention are used in open structure footwear.

Accordingly, it will now be seen that the components of the present foot support are designed to modify standard footwear interiors to achieve orthotic correction. It has been found that the planar or level configuration of the support utilizing materials of variable density or durometer can be pre-cut to fit ordinary footwear without modification.

Thus, the orthotic that is effected is also enhanced by a two-fold action. First the device itself is easily assembled from conventional or standardized parts and provides a totally effective orthotic surface for the foot. Secondly, it has been found that by utilizing a compressible, malleable material which takes a set as it is worn in normal use, the final contour of the support will conform to the required support for the foot in use in contrast with simply providing a support that conforms with the configuration of the foot when it is in a static state. The residual resilience of the support material provides impact absorbtion and pressure dispersion and further allows the foot, and more particularly the muscles, tendons and related structural elements of the foot, to react to provide as much natural correction and rehabilition of the foot as possible, thereby limiting corrective effects to those which are necessary. This can avoid atrophy and progressive deterioration of already weak or eccentric portions of a foot and related muscular/skeletal structures.

Further, because the support acquires its configuration as a result of the selection of the segments in combination with the natural action of the foot, the degree of normal judgment and educated "guesswork" involved in configuring the device is reduced and incorrect or uncomfortable devices are infrequent as is over-correction the degree is determined by the patient's weight. It should also be noted that the layers of the support are also disposed in the same order of firmness as the plantar surface, with the softest layer contacting the soft tissue surface of the foot, the control layer being next in order as are the muscle and tendon layers of the foot, and lastly, the base, as are the bones. This arrangement has been found to effect maximum of comfort to the wearer.

The present invention further encompasses the method of forming an orthotic. In accordance with this method, there are formed a plurality of foot supporting segments, each of the segments being shaped to underlie a predetermined functional portion of a foot, each of the individual sections being formed from a material of selected durometer ranging from 120 BHN to 180 BHN or greater to effect maximum to minimum descent of the foot corresponding in accordance with the insole of a shoe and subjecting the sections to dynamic pressure of the foot as it is used, whereby the support is deformed to a contour that is the resultant of the combined effects of the durometer of the individual segments and the pressure supplied thereto by the planar surface of the foot.

The method of the invention can be further enhanced by laminating the sections to a supporting base and cementing a mask layer to the surface of the supporting sections opposite said base layer.

It will, be obvious to those skilled in the art that other configurations of the supporting sections can also be utilized without departing from the spirit or scope of the present invention. For example, the support could be formed by utilizing a matrix member which would be fabricated from a soft, resilient material and be provided with a plurality of standard sized openings. The openings in turn could correspond to the various functional portions of the foot and the elements, again selected from an appropriate range of durometers, could be inserted into the individual openings of the matrix. It is also within the conception of the present invention that supports could be made which incorporate one to as many as nine or more segments, with the number of segments being appropriately selected in view of the ultimate corrections to be effected.

Lastly, it will be seen that the device of the present invention can be readily supplied in the form of prepackaged kits. In such a kit, support segments from each of the desired durometer ranges can be provided with all of the segments in a particular kit being and dimensioned to match a standard shoe size. The kit also provides a base and mask layer and a suitable mastic for assembling the device once the desired segments have been selected.

It should further be observed that, while the invention has been described as comprising a plurality of lamina which are cemented together, other means for securing the segments to a supporting base or even directly to a specially fabricated shoe could be utilized. For example, individual segments could be provided with dowel-like protruberances which would interlockingly engage complementary recesses in specially fabricated shoes, or, more simply, in corresponding complementary recesses provided in a removable insole.

While the above description has been presented with respect to providing orthopedic correction to feet, it will also be apparent to those skilled in the art that the same device can provide additional comfort for normal feet and in particular, to providing additional support and relief in athletic shoes, which is often required during vigorous athletic activities such as basketball, running the the like.

While there have been described above the principles of this invention in connection with specific apparatus, it is to be clearly understood that this description is made only by way of example and not as a limitation to the scope of the invention.

What is claimed is:

1. An orthotic device comprising a resilient member having a perimetral outline conforming to a predetermined portion of the human foot, said member including a plurality of adjoining segments, each said segment having a perimetral outline conforming to a predetermined different portion of the human foot and, at least a portion of said outline being complementary to at least a portion of the perimetral outline of an adjoining segment, each said segment being constructed from a material having a predetermined range of firmness and having a constant vertical thickness, all of said segments being of the same thickness to form a said member of uniform thickness, the firmness of said segments being selected from one of a group of ranges of durometer 120 BHN or less, about 140 BHN, and 180 BHN and greater, and each said segment being compressible independently of adjoining segments.

2. The device of claim 1 further including a flexible mask layer fixedly secured to the upwardly disposed surfaces of said segments.

3. The device of claim 2, further including a flexible, base member fixedly secured to the under surface of said segments.

4. The device of claim 1, wherein said member is made of a substantially resilient material that acquires a partial set in response to compression.

5. The device of claim 4, wherein said material is a closed cell, cross-linked polyethylene.

6. The device of claim 4, wherein said material is polyvinylchloride foam.

7. The device of claim 1, wherein adjacent ones of said segments are provided with complementary perimetral portions, whereby, individual ones of said segments are joined to adjacent ones of said segments to form a lamina complementary to a predetermined portion of a human foot.

8. The device of claim 1, wherein there are four said segments, said segments having perimetral configurations proportioned to underlie the netatarsal heads, the medial midfoot, lateral midfoot, and the heel portions of the foot, respectively.

9. The device of claim 8 wherein the forwardly disposed edges of said metatarsal head segments are disposed along an angled line extending at an angle of about 142 degrees from a point on that one of said metatarsal segments underlying the second metatarsal articulation.

10. The device of claim 1 wherein there are a plurality of said segments having perimetral configurations and being disposed to underlie predetermined individual ones of the metatarsal heads.

11. The device of claim 1, wherein said member has a vertical section of 50 millimeters or less.

12. An orthotic device comprising a resilient, planar member having a plurality of adjoining segments of constant vertical thickness, each said segment having a perimetral outline configured and positioned to underlie a predetermined portion of the plantar surface of the human foot, at least a portion of said outline being complementary to at least a portion of the perimetral outline of an adjoining segment, the firmness of each said segment being selected from one of the ranges of durometer values of 120 BHN and less, greater than 120 BHN and less than 180 BHN, and 180 BHN and greater, to produce individual segments having variable resistance to pressures exerted thereagainst by said predetermined portion of the plantar surface of the foot to thereby control descent of the corresponding portion of the foot when in use.

13. The device of claim 12, wherein each said segment is initially planar, each said segment acquiring a vertical contour complementary to the corresponding portion of the plantar surface, said contour being the resultant of the combined action of the contour of said portion of the plantar surface and the pressure exerted thereby against said segment and the firmness of said segments.

14. The device of claim 13, wherein said segments are made from a closed cell, cross-linked polyethylene foam.

15. The device of claim 14, further including a flexible layer overlying and fixedly secured to the upwardly disposed surface of said member.

16. The device of claim 15, further including a flexible, compressible base layer underlying and fixedly secured to the under surface of said member.

17. The device of claim 13, wherein said segments are made of polyvinylchloride foam.

18. A kit for assembling an orthotic device comprising a flexible, base layer having a perimetral outline conforming to the shape of the plantar surface of a human foot, a plurality of adjoining control segments of uniform vertical thickness having perimetral configurations conforming to predetermined portions of said plantar surface and at least a portion of the outline of each segment being complementary to at least a portion of the perimetral outline of an adjoining segment, said control segments being made of a material of selected durometer from each of the durometer ranges of BHN 120 and less, BHN 140, and BHN 180 and greater, and a flexible mask layer of the same perimetral dimensions as said base layer; said base layer, said control layer, and said cushion layer, when assembled, conforming to a predetermined standard shoe size.

19. The kit of claim 18, wherein said mask layer further includes a moisture absorbing surface layer.

20. The kit of claim 19, wherein selected ones of said control segments, when assembled, have a perimetral outline complementary to a predetermined portion of the plantar surface of a human foot.

21. The kit of claim 18 wherein each of said control segments is of the same thickness.

22. The kit of claim 21, wherein each said control segment is made from a resilient material that takes a predetermined percentage set in response to pressure.

* * * * *